US007727024B2

(12) United States Patent
Chou et al.

(10) Patent No.: US 7,727,024 B2
(45) Date of Patent: Jun. 1, 2010

(54) ELECTRICAL ADAPTER ASSEMBLY AND APPARATUS USING THE SAME

(75) Inventors: Chun-Hung Chou, Taipei Hsien (TW); Mei-Fang Zhong, Shenzhen (CN)

(73) Assignees: Hong Fu Jim Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/396,473

(22) Filed: Mar. 3, 2009

(65) Prior Publication Data

US 2009/0233490 A1 Sep. 17, 2009

(30) Foreign Application Priority Data

Mar. 12, 2008 (CN) ..... 200810300527

(51) Int. Cl.
*H01R 25/00* (2006.01)

(52) U.S. Cl. ..... 439/638

(58) Field of Classification Search ..... 439/638, 439/928.1, 945, 76.1; 361/679.33
See application file for complete search history.

(56) References Cited

U.S. PATENT DOCUMENTS

| | | | | |
|---|---|---|---|---|
| 5,519,571 | A * | 5/1996 | Shieh | 361/679.37 |
| 6,648,695 | B1 | 11/2003 | Wu | |
| 7,453,692 | B2 * | 11/2008 | Chen | 361/679.33 |
| 7,513,801 | B2 * | 4/2009 | Cheng et al. | 439/638 |
| 2003/0109179 | A1 * | 6/2003 | Kaneshiro et al. | 439/638 |
| 2005/0120153 | A1 * | 6/2005 | Perez et al. | 710/62 |

* cited by examiner

*Primary Examiner*—Phuong K Dinh
(74) *Attorney, Agent, or Firm*—Frank R. Niranjan

(57) ABSTRACT

An electrical adapter assembly for connecting a first hard disk drive and a second hard disk drive. The electrical adapter assembly includes a first connector and a second connector. The first connector includes a first golden fingers capable of electrically inserting into the first hard disk drive and a second golden fingers electrically connecting to the first golden fingers. The second connector includes a first plug electrically connecting the second connector to the second golden fingers, a second plug capable of electrically inserting into the second hard disk drive, a chip configured for controlling data transfer between the first hard disk drive and the second hard disk drive, and circuits connecting the chip to the first connector and the second connector.

20 Claims, 3 Drawing Sheets

ELECTRICAL ADAPTER ASSEMBLY AND APPARATUS USING THE SAME

BACKGROUND

1. Technical Field

Embodiments of the present disclosure generally relate to connector assemblies, and particularly, to an electrical adapter assembly for hard disk drives.

2. Description of Related Art

Hard disk drives are widely used as mass storage devices in computers and other devices needing large capacity storage. To transfer information/data from one hard disk drive to a second hard disk drive, the two hard disk drives must be connected to a motherboard of a computer and the operating system of the computer must be used to transfer the information/data. After the information/data is transferred and if one of the hard disk drive is to be used on a second computer, the hard disk drive must be detached and installed on the motherboard of the second computer. As can be seen, this is a tedious and time consuming process.

Therefore, a need exits for providing an electrical adapter assembly that can conveniently and repeatedly connect hard disk drives to each other without interfacing to a motherboard.

DETAILED DESCRIPTION

Figure 1:
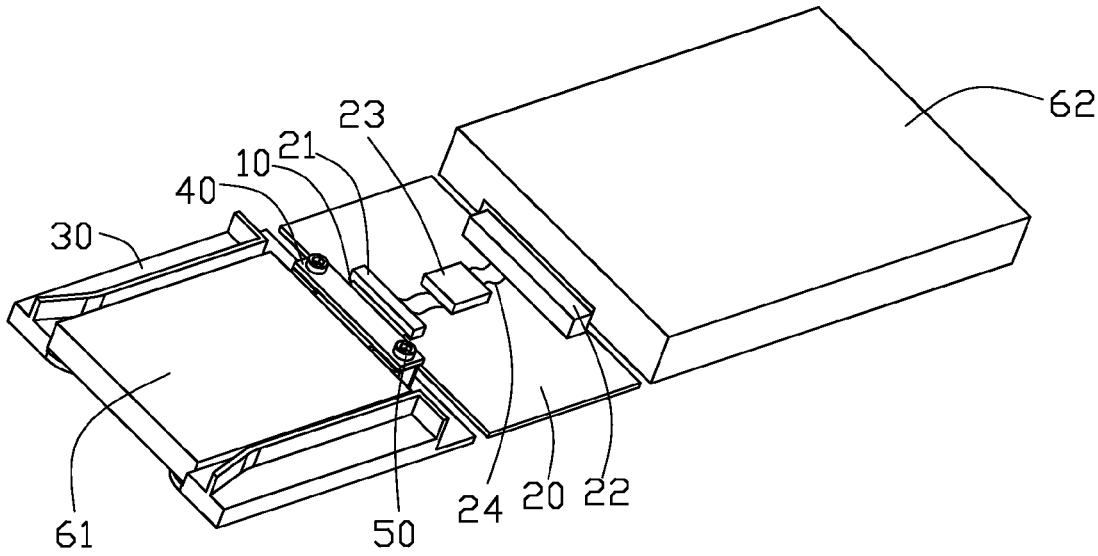
FIG. 1 is an isometric view of the electrical adapter assembly connecting two hard disk drives to each other and supporting one of the hard disk drives thereon in accordance with an exemplary embodiment.
Figure 2:
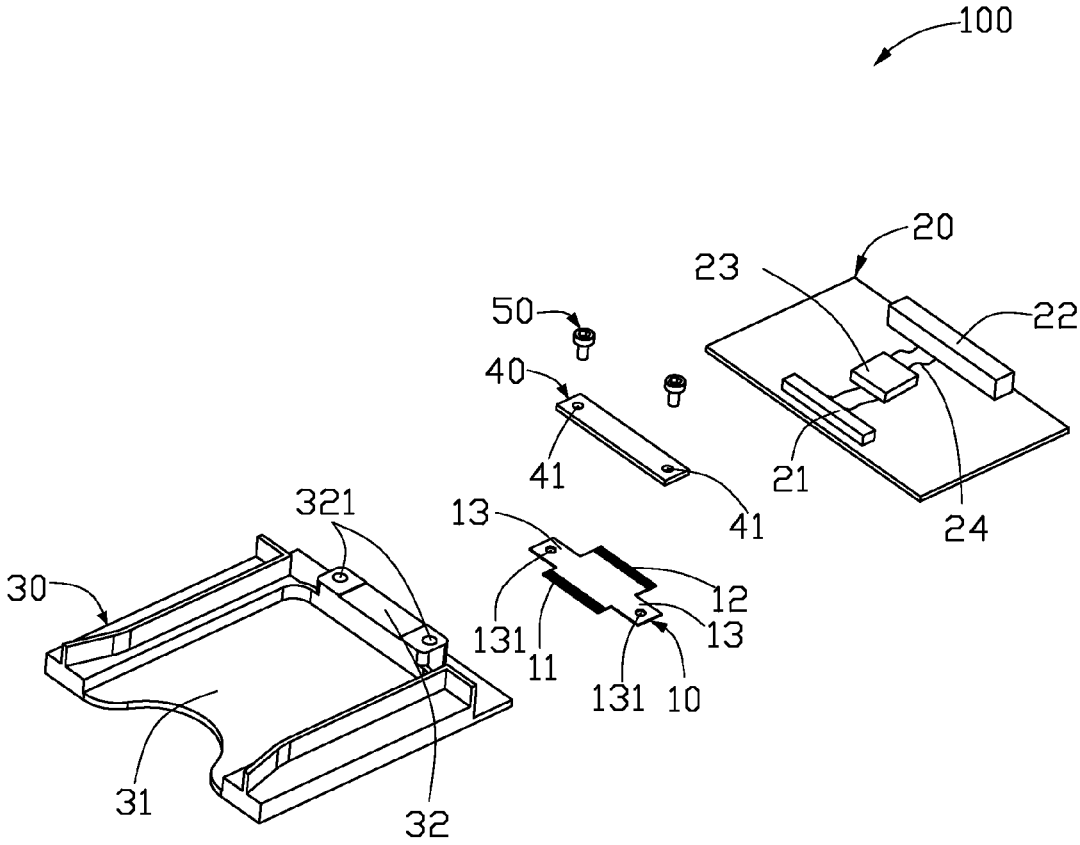
FIG. 2 is exploded perspective view of an electrical adapter assembly of FIG. 1.

Referring to FIGS. 1, 2, an electrical adapter assembly 100 in accordance with an exemplary embodiment is configured for electrically connecting a first hard disk drive 61 to a second hard disk drive 62. The electrical adapter assembly 100 includes a first connector 10, a second connector 20, a loading member 30, a pressing member 40, and two fixing members 50. The first connector 10 electrically connects with the second connector 20, and is fastened on the loading member 30 by the pressing member 40 and the fixing members 50.

The first connector 10 is a rectangle-shaped printed circuit board, having a thickness of about 0.2 mm. The first connector 10 includes first golden fingers 11, second golden fingers 12, and two fixing portions 13. The first golden fingers 11 and the second golden fingers 12 are respectively disposed at two opposite edges of the first connector 10. The two fixing portions 13 are respectively disposed at another two opposite edges of the first connector 10. The first golden fingers 11 and the second golden fingers 12 electrically connect with each other. Each of the fixing portions 13 defines a fixing hole 131.

The second connector 20 includes a first plug 21 and a second plug 22. Each of the first plug 21 and the second plug 22 includes a plurality of pins (not shown). The first plug 21 electrically connects the second golden fingers 12. The second connector 20 further includes a chip 23, and circuits 24 for electrically connecting the chip 23 to the first plug 21 and the second plug 22. The chip 23 is used for controlling data transfer between the first hard disk drive 61 and the second hard disk drive 62.

The loading member 30 defines a receiving slot 31 for receiving the first hard disk drive 61, and further includes a supporting portion 32 for supporting the first connector 10. The supporting portion 32 may be a protruding portion adjoining the receiving slot 31. Two fastening holes 321 are defined at opposite sides of the supporting portion 32. The two fastening holes 321 correspond to the two fixing holes 131 of the first connector 10.

The pressing member 40 is a flat-shaped board for pressing the first connector 10 to the supporting portion 32 of the loading member 30. The pressing member 40 defines two through holes 41 in the board corresponding to the two fixing holes 131 of the first connector 10. The two fixing members 50 are used for respectively passing through the two through holes 41 and the two fixing holes 131 sequentially, and engaging with the two fastening holes 321, to fix the first connector 10 onto the supporting portion 32 of the loading member 30. The two fixing members 50 may be two screws and the two fastening holes 321 may be threaded.

Figure 3:
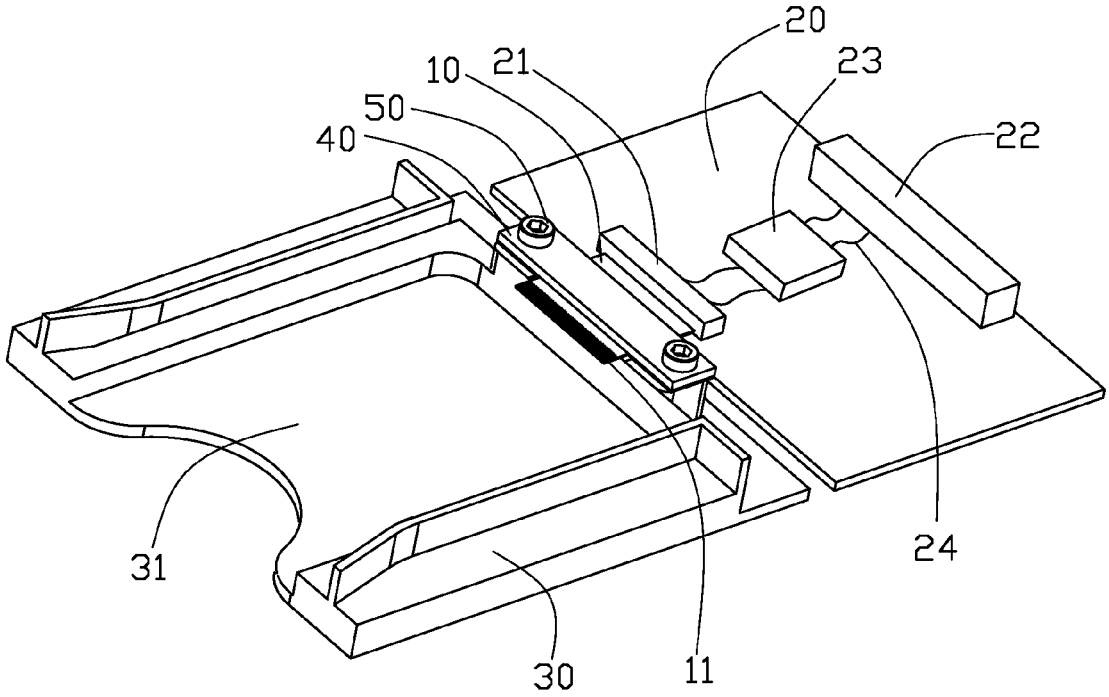
FIG. 3 is an isometric view of the electrical adapter assembly of FIG. 2.

Referring also to FIG. 3, in assembly, firstly, the first connector 10 is disposed on the supporting portion 32 of the loading member 30, and the two fixing holes 131 of the first connector 10 are aligned with the two fastening holes 321 of the supporting portion 32. Secondly, the pressing member 40 is disposed on the first connector 10, and the two through holes 41 are aligned with the two fixing holes 131 of the first connector 10. Thirdly, the two fixing members respectively pass through the two through holes 41 and the two fixing holes 131 sequentially, and screw into the two fastening holes 321 to fix the first connector 10 on the supporting portion 32 of the loading member 30. Finally, the second golden fingers 12 are inserted into the first plug 21 to electrically connect the first connector 10 to the second connector 20.

When the electrical adapter assembly 100 is used for connecting the first hard disk drive 61 to the second hard disk drive 62, the first hard disk drive 61 can slide into the receiving slot 31 to allow the first golden fingers 11 to insert into a hard disk connector (not shown) of the first hard disk drive 61. The second plug 22 of the second connector 20 can be inserted into a hard disk connector (not shown) of the second hard disk drive 62. Therefore, the electrical adapter assembly 100 electrically connects the first hard disk drive 61 to the second hard disk drive 62, thereby the first and second hard disk drives 61, 62 can transfer data therebetween under control of the chip 23 of the second connector 20.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electrical adapter assembly for connecting a first hard disk drive and a second hard disk drive, the electrical adapter assembly comprising:

a first connector comprising first golden fingers capable of electrically inserting into the first hard disk drive, and second golden fingers electrically connecting to the first golden fingers; and a second connector comprising:

a first plug electrically connecting the second connector to the second golden fingers;

a second plug capable of electrically inserting into the second hard disk drive;

a chip configured for controlling data transfer between the first hard disk drive and the second hard disk drive; and circuits connecting the chip to the first connector and the second connector.

2. The electrical adapter assembly as claimed in claim 1, wherein the first connector is a printed circuit board.

3. The electrical adapter assembly as claimed in claim 2, wherein a thickness of the first connector is about 0.2 mm.

4. The electrical adapter assembly as claimed in claim 1, further comprising a loading member for supporting the first hard disk drive.

5. The electrical adapter assembly as claimed in claim 4, wherein the first connector is fixed on the loading member.

6. The electrical adapter assembly as claimed in claim 5, wherein a supporting portion protrudes from the loading member for supporting the first connector.

7. The electrical adapter assembly as claimed in claim 6, wherein the supporting portion defines a fastening hole, the first connector defines a fixing hole corresponding to the fastening hole, a fixing member passes through the fixing hole and engages with the fastening hole to fix the first connector to the supporting portion.

8. The electrical adapter assembly as claimed in claim 7, further comprising a pressing member for pressing the first connector.

9. The electrical adapter assembly as claimed in claim 4, wherein the loading member defines a receiving slot for receiving the first hard disk drive.

10. The electrical adapter assembly as claimed in claim 1, wherein the first golden fingers and the second golden fingers are respectively disposed at opposite edges of the first connector.

11. An electrical adapter assembly, comprising:

a loading member for loading a hard disk drive;

a connector fixed on the loading member, the connector comprising golden fingers for electrically inserting into the hard disk drive;

a supporting portion protruding from the loading member for supporting the connector, the supporting portion defines a fastening hole, the connector defining a fixing hole corresponding to the fastening hole; and a fixing member passing through the fixing hole and screwed into the fastening hole to fix the first connector on the supporting portion.

12. The electrical adapter assembly as claimed in claim 11, wherein the connector is a printed circuit board.

13. The electrical adapter assembly as claimed in claim 12, wherein a thickness of the connector is about 0.2 mm.

14. The electrical adapter assembly as claimed in claim 11, further comprising a pressing member for pressing the connector.

15. The electrical adapter assembly as claimed in claim 11, wherein the loading member defines a receiving slot for receiving the hard disk drive.

16. An apparatus comprising:

a first storage device capable of storing data;

a second storage device capable of storing data; and an electrical adapter assembly for transmitting the data between the first storage device and the second storage device, the electrical adapter assembly comprising a first connector electrically connected with the first storage device, and a second connector electrically connected with the first connector and the second storage device;

wherein the first connector comprises first golden fingers capable of electrically inserting into the first hard disk drive, and second golden fingers electrically connecting to the first golden fingers; and the second connector comprises a first plug electrically connecting the second connector to the second golden fingers, a second plug capable of electrically inserting into the second hard disk drive, a chip configured for controlling data transfer between the first hard disk drive and the second hard disk drive; and circuits connecting the chip to the first connector and the second connector.

17. The apparatus as claimed in claim 16, wherein the electrical adapter assembly further comprises a loading member for supporting the first hard disk drive.

18. The apparatus as claimed in claim 17, wherein the first connector is fixed on the loading member.

19. The apparatus as claimed in claim 18, wherein a supporting portion protrudes from the loading member for supporting the first connector.

20. The apparatus as claimed in claim 19, wherein the supporting portion defines a fastening hole, the first connector defines a fixing hole corresponding to the fastening hole, a fixing member passes through the fixing hole and engages with the fastening hole to fix the first connector to the supporting portion.

* * * * *